United States Patent [19]

Emslander et al.

[11] Patent Number: 4,708,249

[45] Date of Patent: Nov. 24, 1987

[54] TWO PART TAPE TAB FOR OPENING A CONTAINER

[75] Inventors: Jeffrey O. Emslander, Minneapolis, Minn.; Curtis L. Larson, Hudson, Wis.

[73] Assignee: Minnesota Mining and Manufacturing Company, St. Paul, Minn.

[21] Appl. No.: 17,913

[22] Filed: Feb. 24, 1987

Related U.S. Application Data

[62] Division of Ser. No. 747,976, Jun. 24, 1985, Pat. No. 4,664,263.

[51] Int. Cl.[4] ..... B65D 65/32

[52] U.S. Cl. ..... 206/630; 206/628; 206/634

[58] Field of Search ..... 206/631–634, 206/628, 630, 605, 608, 610, 813; 229/43; 383/35

[56] References Cited

U.S. PATENT DOCUMENTS

| | | | |
|---|---|---|---|
| Re. 31,571 | 5/1984 | Mann | 206/443 |
| 1,641,408 | 9/1927 | Bainbridge . | |
| 2,527,073 | 10/1950 | Port . | |
| 2,648,463 | 8/1953 | Scherer | 206/633 X |
| 2,699,286 | 1/1955 | Geoffroy . | |
| 2,745,754 | 5/1956 | Steinbock | 206/633 X |
| 2,799,462 | 1/1957 | Hoag . | |
| 3,054,680 | 9/1962 | Mennen | 99/171 |
| 3,104,047 | 9/1963 | Weeks . | |
| 3,185,372 | 5/1965 | Ferraro | 229/3.5 |
| 3,189,253 | 6/1965 | Mojonnier | 206/610 |
| 3,195,722 | 7/1965 | Duden . | |
| 3,259,235 | 7/1966 | Sowle . | |
| 3,439,866 | 4/1969 | Kuhnle . | |
| 3,442,436 | 5/1969 | Kirby, Jr. | 206/628 X |
| 3,446,637 | 5/1969 | Le Van | 206/620 X |
| 3,450,328 | 6/1969 | Barrett | 206/628 X |
| 3,535,409 | 10/1970 | Rohde | 264/95 |
| 3,595,468 | 7/1971 | Repko . | |
| 3,616,990 | 11/1971 | Powell . | |
| 3,759,439 | 9/1973 | Cross et al. | 206/630 |
| 3,893,460 | 7/1975 | Karami . | |
| 3,983,994 | 10/1976 | Wyslotsky | 206/633 X |
| 4,038,425 | 7/1977 | Brandberg et al. | 426/107 |
| 4,141,487 | 2/1979 | Faust et al. | 229/43 |
| 4,288,027 | 9/1981 | Peterson | 229/43 |
| 4,292,332 | 9/1981 | McHam | 426/111 |
| 4,353,460 | 10/1982 | Kahn | 206/3 |
| 4,420,080 | 12/1983 | Nakamura | 206/449 |

FOREIGN PATENT DOCUMENTS

| | | |
|---|---|---|
| 3021989 | 2/1982 | Fed. Rep. of Germany . |
| 2120312 | 8/1972 | France . |

*Primary Examiner*—Stephen Marcus
*Assistant Examiner*—Bryon Gehman
*Attorney, Agent, or Firm*—Donald M. Sell; James A. Smith; Leland D. Schultz

[57] ABSTRACT

A tab formed on a length of pressure-sensitive adhesive tape and having a cut in the tab permits tearing of the tab and tape lengthwise to open a hole in a flexible packaging material to expose the contents. The tape is placed over an opening formed in the material and the tearing of the tape tab by separating the two portions on either side of the cut will cause a tearing of the tape longitudinally causing a single tear at the opening to propagate in opposite directions from the opening.

3 Claims, 7 Drawing Figures

TWO PART TAPE TAB FOR OPENING A CONTAINER

This is a division of application Ser. No. 747,976 filed June 24, 1985, now U.S. Pat. No. 4,664,263.

BACKGROUND OF THE INVENTION

1. Field of the Invention

This invention relates to a tape tab for a package which tab permits the easy opening of the package, and in one aspect relates to an inexpensive, easy opening device for a convenience food package permitting the opening of the package after the contents have been heated.

2. Description of the Prior Art

Packages have been provided with tear tapes and other convenient structures permitting the tearing of the flexible material forming at least a portion of the package for convenience foods or for any package having a primary wrapping to protect the contents.

The present invention however provides a simplified and direct opening device for a package and reduces the amount of tear tape material utilized in defining the easy opening tab.

SUMMARY OF THE INVENTION

The present invention relates to a new easy open package for permitting easy access to the contents of the package when the package is formed with at least a portion of flexible tearable material. The thin flexible material preferably is adapted to tear upon opposed or oppositely directed forces being exerted to the material and/or to opposite sides of a cut or opening formed in the material to propagate a tear. To this portion of the package is adhered a length of tape having a discontinuity permitting a tearing of the tape between its edges and a tearing of the material beneath the tape.

The length of tape is adhered to the material and covers the cut or opening. The cut or opening in the material may be in the form of a slit, a hole, or a series of perforations. A slit may be formed with diverging slits at one end. The tape comprises a backing having a coating of adhesive material on one surface of the backing which adhesive adheres the backing to the flexible material surrounding the opening. The tape is formed with a tab at a position spaced from the opening in the package. The tab may be formed by folding the tape upon itself, by applying a piece of material over an exposed portion of the tape to detacify the adhesive or by placing a second piece of tape with one portion thereof in contact with the adhesive coating on the first piece of tape. The tab is formed along its free edge with a discontinuity in the form of a slit or notch in the free end of the tab tape between the edges of the tape. The discontinuity in the tab is directed toward the portion of the tape adhered to the material over the opening. The tab and its discontinuity thus forms means by which a tear may be initiated in the tape to tear the tab and the tape adhered to the material causing a tearing of the material beneath the tear in the tape which will be then propagated through the material to afford an opening large enough to permit access to the contents of the package.

Means may be provided to initially adhere the tab in the plane of the remainder of the tape to negate the possibility of premature tearing of the tape during packaging and handling operations.

BRIEF DESCRIPTION OF THE DRAWINGS

The present invention will be described in greater detail with reference to the accompanying drawings wherein.

DESCRIPTION OF THE PREFERRED EMBODIMENTS

Figure 1:
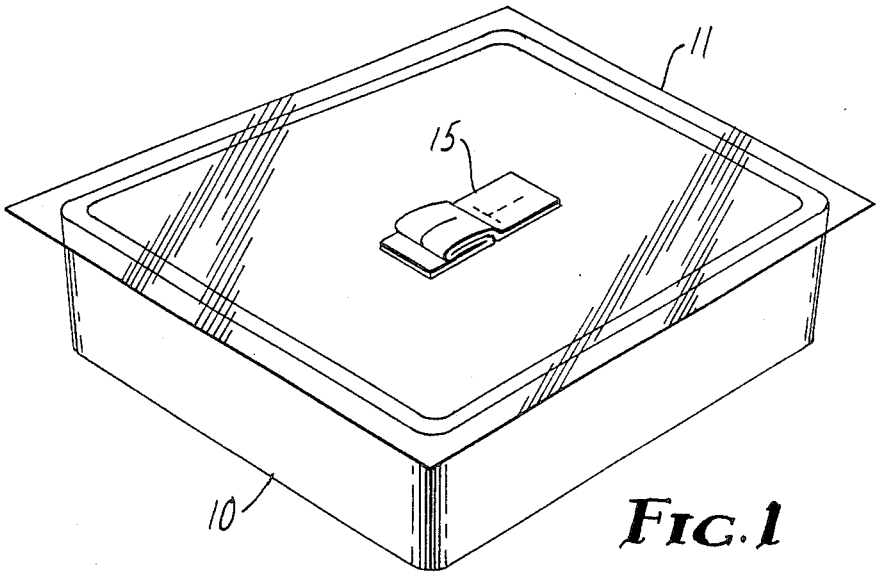
FIG. 1 is a perspective view of a convenience food package having at least a portion thereof formed of flexible material with an easy open tab of the present invention provided thereon.

Referring to FIG. 1 there is illustrated a convenience food package which comprises a tray 10 formed with a flexible cover 11 which is formed of a flexible material to protect the contents of the package. Examples of the flexible material will be defined hereinafter. This flexible material portion 11 of the package is formed with an easy open tab 15 constructed according to the present invention.

Figure 2:
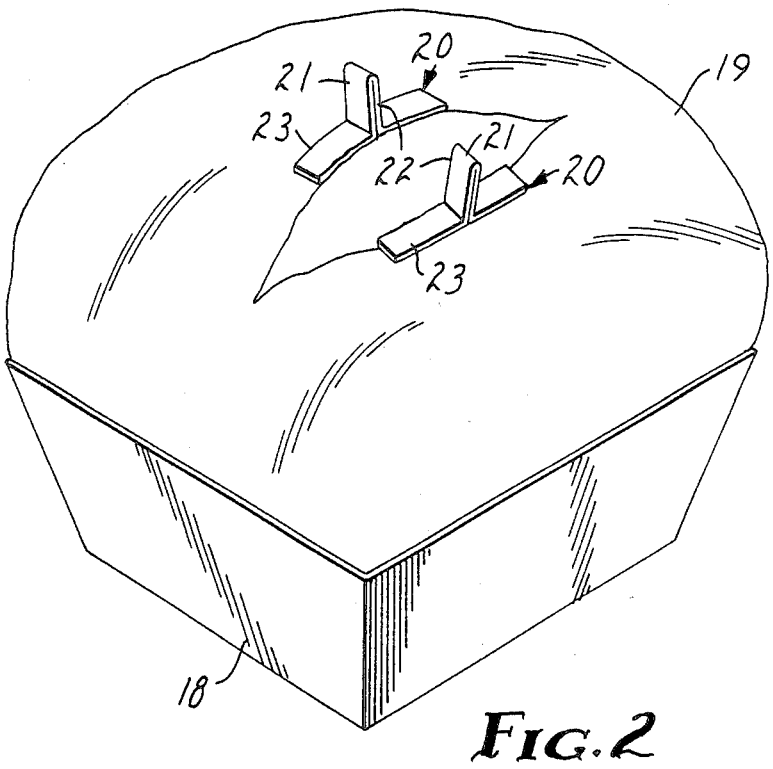
FIG. 2 is a perspective view of a convenience food package having an easy open tab constructed according to the present invention showing the package opened.

FIG. 2 shows a further embodiment of a convenience food package which may be adapted for microwave cooking comprising a tray 18 which supports a bag 19 formed of a flexible polymeric material such as the bags formed for containing microwavable popcorn. The flexible bag 19 of the illustrated package is formed with an easy open tab 20 constructed according to the present invention. As illustrated the tape tab 21 has been separated at a preformed slit 22 and the tape 23 has torn longitudinally.

Figure 3:
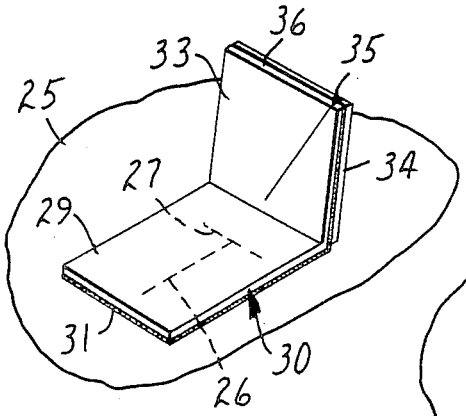
FIG. 3 is a detailed perspective view of an easy open tab constructed according to the present invention.

Referring now to FIG. 3 there is illustrated a detailed perspective view of an easy open tape tab structure according to the present invention. FIG. 3 shows a portion of flexible material 25 of a container. This portion of material 25 is formed with a slit 26 extending therethrough. The slit 26 communicates with a transverse slit 27 which thus forms a T-shaped slit. Positioned over this slit is a length of tape 30. The tape comprises a backing 29 having on one surface a layer of adhesive 31 which adheres the tape backing to the flexible portion 25 over the slit 26, 27. One portion of the tape is formed to define a tab 33 which is formed to be loose or free of the portion 25. This is accomplished by folding the tape 30 upon itself such that the tab 33 is formed by positioning adhesive against adhesive. The tab 33 may alternatively be formed, as illustrated, by positioning a piece of material 34 such as paper, another film, or a detacifying substance against the exposed adhesive.

The tab 33 thus formed is provided with a discontinuity 35 along its free edge 36. The discontinuity illustrated in FIG. 3 is a slit in the tab which is directed toward a central portion of the tape adhered to the portion 25 and toward a position generally aligned with the slit 26 in the portion 25.

The portions of the tab 33 defined by the slit 35 may then be grasped one tab portion between the thumb and index finger of each hand and moved apart to open the discontinuity 35 and cause a tearing of the portion 37 of the tape 30 adhered to the package. Tearing the tab 33 toward the opening 26, 27 eventually causes a tearing and separation of the portion 25 at the slit 26 and a migration of the slit 26 through the portion 25. The tearing will also migrate along the slit 27 to cause an enlarged opening to be formed in the portion 25.

Figure 4:
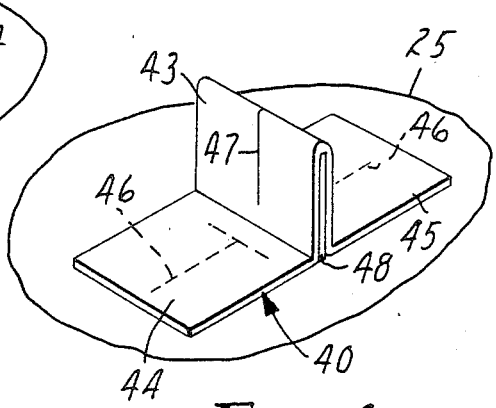
FIG. 4 is a detailed perspective view of another embodiment of the present invention.

Referring now to FIG. 4 there is illustrated a second embodiment of the present invention wherein the opening tab is formed by a length of tape 40 which is folded upon itself between the ends of the tape to form a tab 43 between two portions or legs 44 and 45, each of which are positioned over opening 46 formed through the flexible material 25 of the package. In this embodiment a slit 47 is formed in the tab 43 and causes a tearing of the tape and an opening of the flexible portion in the same manner as described with respect to FIG. 3. Further, a piece of web material 48 such as paper or other plastic material having printed messages thereon could be positioned between the folded areas of the tape defining the tab 43 to give the tab greater thickness than the thickness of the tape and to provide a means for inexpensively applying printed indicia to the tab to include such things as opening instructions.

Figure 5:
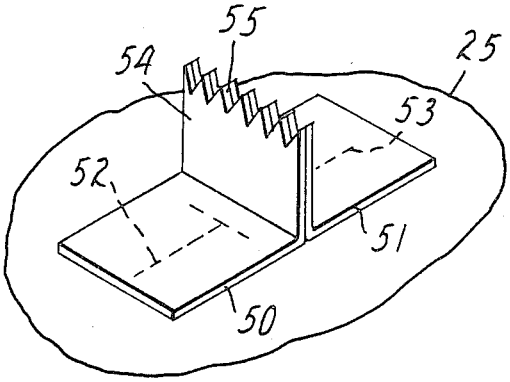
FIG. 5 is a detailed perspective view of another embodiment of the present invention.

Referring to FIG. 5 there is illustrated a further embodiment wherein the opening tab is formed by two lengths of tape 50 and 51, one of which has a portion applied over a first opening 52 and the second has a portion applied over a second opening 53. The opposite ends of the two tapes are positioned in opposed relationship and are adhered together to define a tab 54. In this embodiment the two tapes are severed at the free end of the tab 54 and the severing of the tape forms a series of notches or slits 55 in the ends of the tapes defining the tab such that a tear may be placed in the tape readily following the notches which would progress through the two lengths of tape 50 and 51 to the openings 52 and 53 in the portion 25, causing the openings in the portion 25 to expand, providing access to the contents of the package.

Figure 6:
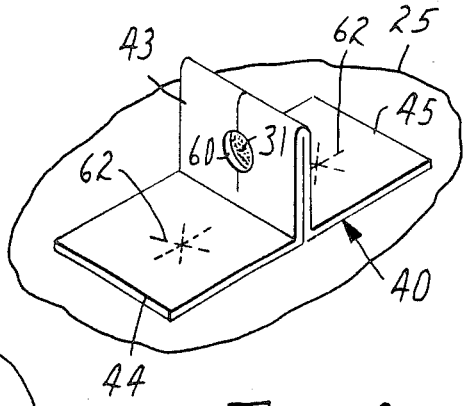
FIG. 6 is a detailed perspective view of a further embodiment.

Referring now to FIG. 6 a further embodiment is illustrated wherein the tab 43 is formed generally as described in FIG. 4, but the tape is folded upon itself, with no strip of material 48 therebetween and an opening 60 is formed in the tape defining the tab 43. The opening 60 is placed in a position to be disposed within the tab 43 which is formed by folding the tapes upon themselves such that through the opening 60 the adhesive surface 31 of the second layer of tape will be exposed through the opening 60. Thus if the tab is folded to the left, as shown in FIG. 6, the adhesive 31 exposed through the opening 60 may contact the top surface of the portion 44 of the tape 40 to hold the tab 43 flat with the plane of the portion 25 of the package such that until use, the tab 43 is tacked down by the adhesive and the tab will not stick up and interfere with further packaging production after the opening tab has been applied to the package. This partial adhesion along the tab permits easy pick up of the tab when opening is desired. FIG. 6 also shows in dotted lines the fact that the opening 62 in the portion 25, which is covered by the tape, may take a configuration different from a T-shaped or Y-shaped slit, a hole or perforated line.

Figure 7:
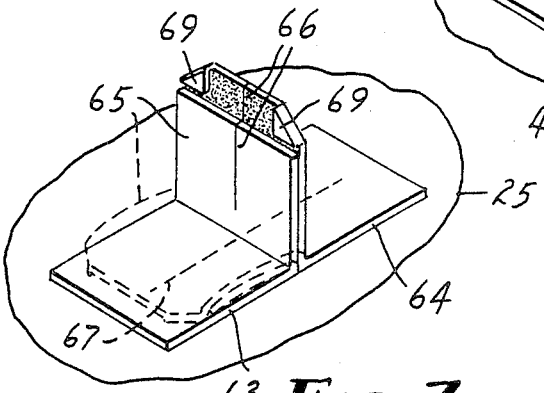
FIG. 7 is a detailed perspective view of a further embodiment of the present invention.

A further example of a tape tab formed to have this hold-down feature is shown in FIG. 7 where the tape tab 65 is formed from two lengths of tape 63 and 64 with the tapes applied to each other. The tape 64 has a portion of its length defining the tab longer than the other tape 63 so the tape 64 extends beyond the end of the second length of tape 63 such that when it is folded down to the position shown in dotted lines the adhesive surface which is exposed on tape 64 may be positioned to contact the nonadhesive coated surface of the other tape 63 or to contact the portion 25 to maintain the tab flat and in a position so as not to obstruct further packaging operations. Preferably the corners of extended end of tape 64 can be folded as illustrated at 69 to form tabs for facile lifting of the tab 65. This tab 65 is formed with an edge discontinuity 66 corresponding to the cuts or notches of the other embodiments. The opening 67 in the material 25 in this embodiment is illustrated as a continuous slit covered by the portions of tape 63 and 64 adhered to the material.

Materials which are thin flexible packaging materials for articles, foods and sterilization and usable with opening tabs of the present invention include polyvinylidene chloride, cellophane, thin, i.e., 0.0005 inch aluminum foil, 0.00035 inch aluminum foil/20 pound paper, biaxially oriented polypropylene film, low density polyethylene, laminates of polyester and polyethylene, polycarbonate films, polyamide films, acetate films, 20 pound kraft paper and biaxially oriented polyethylene terephthalate.

The tape materials for the easy-open tape tabs comprise a backing which will propagate a tear along its length. Such backings may have an embossed line or lines which define lines of tear, longitudinally extending fibers or they may be oriented to tear directionally. The tapes are pressure sensitive adhesive tapes. Examples of backing materials include polyethylene terephthalate, acetate, polypropylene, paper and fiber reinforced backings, and uniaxially oriented thermoplastic films. The best tape for a particular use is determined by the conditions under which the tab will be used. Examples of different uses where the particular tab material, backing and adhesive, must be carefully chosen include high temperatures (microwave cooking), grease, humidity, boiling water, elimination of odor or taste.

A preferred example is a uniaxially oriented polypropylene backing oriented between about 3 to 1 to 10 to 1 and having a synthetic rubber/resin pressure sensitive adhesive.

Having thus described the present invention, what is claimed is:

1. An easy open package for enclosing a product in a sealed flexible container, said package comprising a flexible portion having first and second openings extending through said portion in spaced relationship, a first length of tape adhered to the flexible material and covering said first opening, a second length of tape adhered to the flexible material and covering said second opening, said tape comprising a backing having a coating of adhesive on one surface of the backing, said adhesive adhering the tape to the material surrounding the opening and each length of said tape having a free end with the free end of one length of tape adhered to the free end of the other length of tape to define together a tab with a free edge formed in a position spaced between said first and second openings, said tab having a discontinuity along said free edge to permit separation of the tab to afford a tearing of the lengths of tape generally centrally thereof, said tearing of the tape being along a line generally aligned with the openings in the material whereby tearing of the tape tends to cause a tearing of the material at said openings.

2. An easy open package according to claim 1, wherein the discontinuity formed in the tab is defined by a notch formed in the free edge of said lengths of tape which are adhered together.

3. An easy open package according to claim 1 wherein said free end of said second length of tape extends beyond the free end of said first length of tape to expose a band of adhesive for holding the tab flat against the material when the tab is folded.

* * * * *